US005957096A

United States Patent [19]

Clarke et al.

[11] Patent Number: 5,957,096

[45] Date of Patent: Sep. 28, 1999

[54] INTERNAL COMBUSTION ENGINE WITH VARIABLE CAMSHAFT TIMING, CHARGE MOTION CONTROL VALVE, AND VARIABLE AIR/FUEL RATIO

[75] Inventors: James Ryland Clarke, Northville; Robert Albert Stein, Saline, both of Mich.

[73] Assignee: Ford Global Technologies, Inc., Dearborn, Mich.

[21] Appl. No.: 09/094,017

[22] Filed: Jun. 9, 1998

[51] Int. Cl.[6] ..... F01L 13/00; F01L 1/34

[52] U.S. Cl. ..... 123/90.15; 123/90.17; 123/305; 123/308

[58] Field of Search ..... 123/90.15, 90.16, 123/90.17, 90.31, 301, 302, 305, 306, 308, 432; 60/285

[56] References Cited

U.S. PATENT DOCUMENTS

| | | | |
|---|---|---|---|
| 2,183,674 | 12/1939 | Erren . | |
| 3,441,009 | 4/1969 | Rafanelli . | |
| 3,888,217 | 6/1975 | Hisserich | 123/90.31 |
| 4,285,310 | 8/1981 | Takizawa et al. . | |
| 4,327,676 | 5/1982 | McIntire et al. . | |
| 4,344,393 | 8/1982 | Etoh et al. . | |
| 4,365,597 | 12/1982 | Iizuka et al. . | |
| 4,401,069 | 8/1983 | Foley . | |
| 4,494,504 | 1/1985 | Yagi et al. . | |
| 4,499,870 | 2/1985 | Aoyama . | |
| 4,516,542 | 5/1985 | Aoyama et al. . | |
| 4,520,775 | 6/1985 | Nakamura . | |
| 4,522,179 | 6/1985 | Nishimura et al. . | |
| 4,534,323 | 8/1985 | Kato et al. . | |
| 4,552,112 | 11/1985 | Nagao et al. . | |
| 4,570,590 | 2/1986 | Kawai et al. . | |
| 4,584,974 | 4/1986 | Aoyama et al. . | |
| 4,667,636 | 5/1987 | Oishi et al. . | |
| 4,702,207 | 10/1987 | Hatamura et al. . | |
| 4,911,113 | 3/1990 | Yamada . | |
| 4,932,377 | 6/1990 | Lyle . | |
| 4,932,378 | 6/1990 | Hitomi et al. . | |
| 4,974,566 | 12/1990 | LoRusso et al. . | |
| 5,119,784 | 6/1992 | Hashimoto et al. . | |
| 5,133,310 | 7/1992 | Hitomi et al. . | |
| 5,165,374 | 11/1992 | Chapman et al. . | |
| 5,190,013 | 3/1993 | Dozier . | |
| 5,228,422 | 7/1993 | Wakeman . | |
| 5,230,320 | 7/1993 | Hitomi et al. . | |
| 5,236,332 | 8/1993 | Satou et al. . | |

(List continued on next page.)

FOREIGN PATENT DOCUMENTS

| | | |
|---|---|---|
| 0105934 | 4/1984 | European Pat. Off. . |
| 0 724 067 | 7/1996 | European Pat. Off. . |
| 0 777 038 | 6/1997 | European Pat. Off. . |
| 52-34108 | 3/1977 | Japan . |
| 55-32976 | 3/1980 | Japan . |
| 55-109724 | 8/1980 | Japan . |
| 57-183553 | 11/1982 | Japan . |
| 58-124019 | 7/1983 | Japan . |
| 58-148230 | 9/1983 | Japan . |
| 60-11206 | 3/1985 | Japan . |
| 60-85222 | 5/1985 | Japan . |
| 61-12940 | 1/1986 | Japan . |
| 61-49121 | 3/1986 | Japan . |
| 2-230920 | 9/1990 | Japan . |
| 3-202619 | 9/1991 | Japan . |

OTHER PUBLICATIONS

Dual Equal VCT—A Variable Camshaft Timing Strategy for Improved Fuel Economy and Emissions, SAE Technical Paper Series 950975, pp. 1–13, R. Stein, K. Galietti and T. Leone.

*Primary Examiner*—Weilun Lo
*Attorney, Agent, or Firm*—Jerome R. Drouillard

[57] ABSTRACT

A reciprocating internal combustion engine has at least one camshaft for actuating intake and exhaust valves and a camshaft drive for rotating the camshaft and for adjusting the rotational timing of the camshaft with respect to the crankshaft. A charge motion control valve and the variable camshaft timing mechanism are both used to selectively impart angular momentum to charge entering the engine's cylinder(s).

21 Claims, 2 Drawing Sheets

U.S. PATENT DOCUMENTS 5,239,960 8/1993 Sasaki et al. .
5,327,859 7/1994 Pierik et al. ..... 123/90.17
5,329,912 7/1994 Matsumoto et al. ..... 123/568
5,359,972 11/1994 Isaka .
5,408,966 4/1995 Lipinski et al. .
5,443,050 8/1995 Hitomi et al. .
5,467,748 11/1995 Stockhausen .
5,487,365 1/1996 Isaka .
5,606,960 3/1997 Takahashi et al. .
5,642,703 7/1997 Stockhausen et al. .
5,669,341 9/1997 Ushirono et al. .
5,765,525 6/1998 Ma ..... 123/308
5,852,994 12/1998 Tsuzuku et al. ..... 123/308

INTERNAL COMBUSTION ENGINE WITH VARIABLE CAMSHAFT TIMING, CHARGE MOTION CONTROL VALVE, AND VARIABLE AIR/FUEL RATIO

TECHNICAL FIELD

The present invention relates to an internal combustion engine having variable cylinder valve timing, and charge motion and air/fuel ratio control.

DISCLOSURE INFORMATION

Engine designers have proposed many types of mechanisms for controlling cylinder valve timing. As used herein, the term "cylinder valve" means the common poppet valve used for intake of charge and exhausting of burnt gases from an engine cylinder. Although variable valve timing has been used in internal combustion engines, the inventors have determined that a synergistic effect occurs when variable valve timing, in this case dual equal or dual independent variable valve timing, is combined with an intake charge motion control valve (CMCV). The combination of dual equal variable cam timing with a CMCV allows an engine to be operated either at or near stoichiometry or at lean conditions, so as to allow the use of a lean NOx trap for the purpose of further reducing air pollution.

The ability to operate both lean and at or near stoichiometric air/fuel ratio is important when using a NOx trap because the engine must be operated lean during normal conditions, so as to allow NOx to accumulate in the trap. When trapped oxides of nitrogen have reached the trap's capacity, the trap must be regenerated. This requires operation at or slightly rich of stoichiometry.

The previously mentioned synergy between the CMCV and the dual equal camshaft timing control importantly allows fuel consumption to be actually less than fuel consumption during lean operation at standard valve timing.

The beneficial results of the present invention occur because the CMCV increases in-cylinder charge motion so as to improve combustion and the ability to handle charge dilution which occurs from increased levels of internal EGR resulting from valve timing retard. The combination of CMCV plus dual equal valve timing retard results in lower effective intake valve lift and causes the directed air flow from the CMCV to flow through the reduced valve flow area at higher velocity, resulting in higher levels of in-cylinder motion. This synergism between the CMCV and the retarding camshaft timing greatly improves the combustion and dilute capability so as to reduce fuel consumption while also reducing feed-gas NOx.

The reader's attention is directed to FIG. 4, which plots fuel consumption against NOx. The NOx shown is feed-gas NOx, i.e., prior to any aftertreatment device. The line labeled "1–4" in FIG. 4 is a plot showing operation of an engine at standard valve timing and also fuel lean combustion. It is noted that fuel consumption generally decreases as the engine is operated at increasingly leaner air/fuel ratios, with NOx also decreasing as the air fuel ratio is increased from 17:1 to 21:1.

The line of FIG. 4, which is labeled 1-2, is a plot of engine operation at the stoichiometric air/fuel ratio. More precisely, line 1-2 illustrates operation of an engine at not only stoichiometric air/fuel ratio, but also with dual equal variable camshaft timing which is increasingly retarded through 10°, 20°, 30°, 40°, and ultimately to 55° (all measured as crankshaft degrees). Note that as the camshaft retard is increased to 55°, the fuel consumption steadily decreases as does the NOx feedgas emitted by the engine. Now, directing the reader's attention to line 2-3 of FIG. 4, if the engine is operated at 50° camshaft retard and 16:1 air/fuel ratio, in other words leaner than with the stoichiometric air/fuel ratio on curve 1-2, an additional fuel economy benefit will be achieved with only a slight increase in feedgas NOx. This beneficial operation may be achieved with port fuel injection shown in FIG. 2.

SUMMARY OF THE INVENTION

A reciprocating internal combustion engine has at least one cylinder with a piston, a crankshaft, a connecting rod joining the piston and the crankshaft, an intake manifold, and intake and exhaust poppet valves servicing the cylinder. The engine further comprises at least one camshaft for actuating the intake and exhaust valves, and a camshaft drive for rotating the camshaft and for adjusting the rotational timing of the camshaft with respect to the crankshaft, with the camshaft having a base timing. A CMCV selectively imparts angular momentum to the charge entering the cylinder. Finally, a controller operates the camshaft drive and motion control valve as well as a fuel system for providing fuel to the engine.

In general, the controller operates the camshaft drive so as to progressively retard the camshaft timing until the engine reaches a predetermined operating condition corresponding to maximum practicable retard. The point of maximum practicable retard may be determined as the point at which the engine's combustion becomes unstable or a point at which the air pressure within the intake manifold approaches ambient air pressure. The CMCV is operated by the controller such that the CMCV is closed during operation at low to moderate loads and open during operation at higher to full engine loads.

According to another aspect of the present invention, the base timing of the camshaft is characterized by a period of valve overlap operation proximate the TDC position of the crankshaft and piston. In the event that the engine is cold, the controller will operate the engine with the camshaft at base timing and the charge motion control valve in the closed position.

DETAILED DESCRIPTION OF PREFERRED EMBODIMENTS

Figure 1:
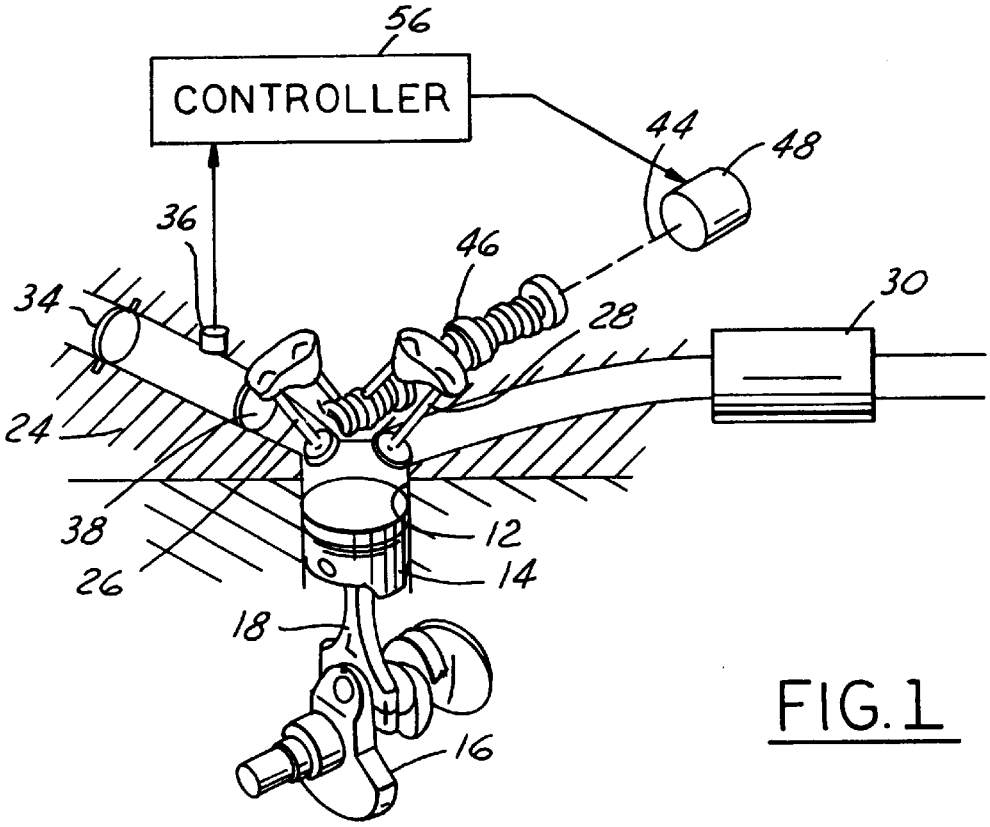
FIG. 1 is a schematic representation of an engine having camshaft timing control and charge motion control according to the present invention.
Figure 2:
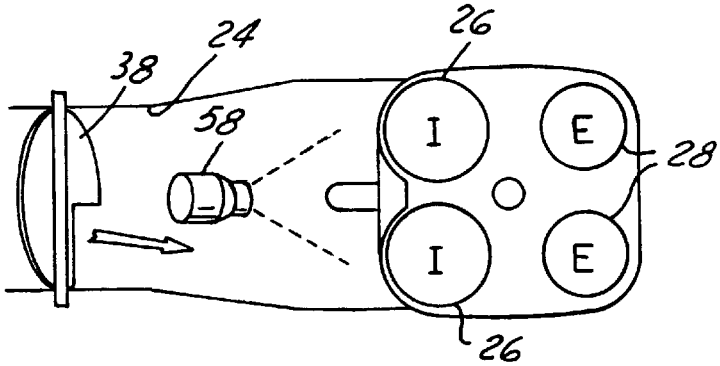
FIG. 2 is a schematic representation of a four valve engine having a charge motion control valve suitable for use with the present invention.
Figure 5:
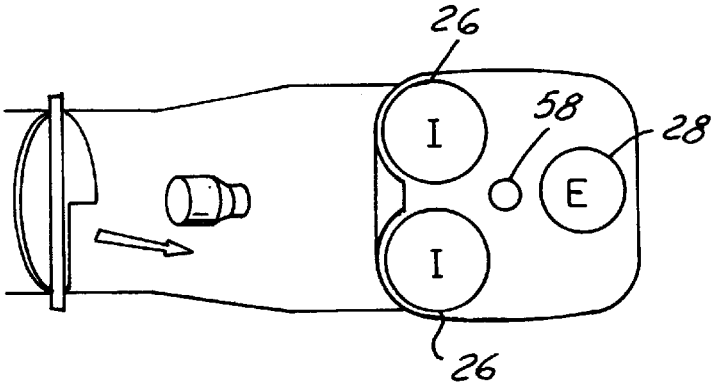
FIG. 5 is a schematic representation of a three valve engine having a fuel injector mounted for providing fuel directly to the engine's cylinder(s).

As illustrated in FIG. 1, engine 10 has cylinder 12 with piston 14 reciprocally mounted therein. Piston 14 is connected with crankshaft 16 by means of connecting rod 18 in conventional fashion. Intake manifold 24 supplies air to the engine, with the air being allowed into cylinder 12 by means of intake valve 26. Although a single intake valve is shown in FIG. 1, FIGS. 2 and 5 illustrate that multiple intake valves may be used with an engine according to the present invention. FIG. 2 further illustrates fuel injector 58 and CMCV 38. Note that CMCV 38 comprises a plate shaped to fit intake manifold passage 24, with approximately one-quarter of CMCV being removed, so as to allow air to preferentially pass through the notched out portion of valve 38 when valve 38 is in its closed position. This preferential passage of air will cause increased in-cylinder charge motion, which will be further augmented by the increased motion caused, as described herein, by retarding the timing of camshaft 44. Those skilled in the art will appreciate in view of this disclosure that other types of configurations could be employed for the CMCV. For instance, the CMCV could have only a lower half, or an upper half, or perhaps only an aperture therethrough.

Returning to FIG. 1, an engine according to the present invention further comprises throttle 34 and intake manifold pressure transducer 36. The cylinder valves, with the intake valve being 26 and exhaust valve 28, are operated by camshaft 44 having a plurality of lobes 46 contained thereon. Camshaft 44 is driven by camshaft drive 48. Camshaft drive may be powered by any known means such as mechanically via a belt or chain, or electrically, or hydraulically.

Controller 56, which is drawn from the class of controllers known to those skilled in the art and used for engine control purposes, operates CMCV 38 and camshaft drive 48. Controller 56 also operates fuel injector 58. Controller 56 receives a variety operating parameter value inputs such as that from intake manifold pressure transducer 36. Those skilled in the art will appreciate from this disclosure that other transducers will be used according to the present invention and these would be drawn from the class of transducers known to those skilled in the art of engine control design. Such transducers could include, without limitation, engine speed, intake manifold temperature, fuel flow rate, injector pulsewidth, throttle angle, vehicle speed, engine coolant temperature, charge air temperature, engine knock, spark timing, and other sensed, calculated, or modeled variables suggested by this disclosure.

Figure 3A:
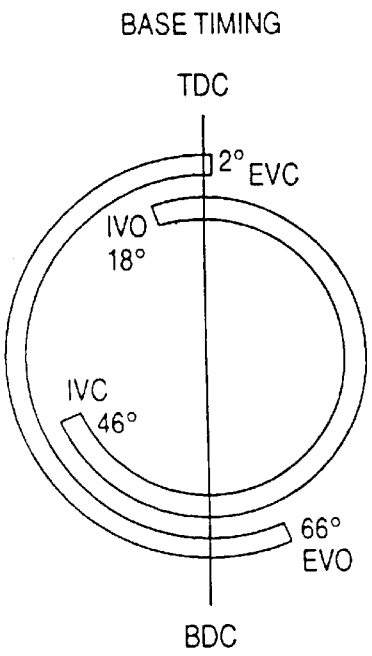
FIGS. 3A and 3B are valve timing diagrams of an engine according to one aspect of the present invention.
Figure 3B:
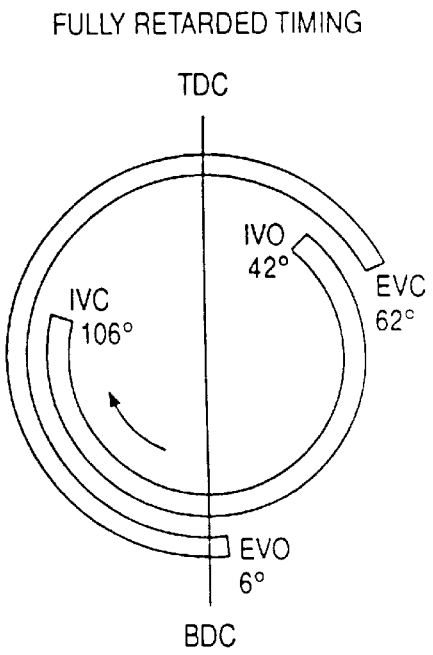

Turning to FIG. 3, beginning with the valve timing diagram labeled "Base Timing", it is seen that the intake and exhaust valve events have an overlap slightly before top dead center (TDC). This is true because Intake Valve Opening (IVO) starts about 18° (crankangle degrees), whereas Exhaust Valve Closing (EVC) occurs about 2° after TDC. Of course, the TDC described herein is the TDC position which marks the transition between the exhaust and intake strokes of a four-stroke cycle internal combustion engine.

At the bottom of the Base Timing diagram, exhaust valve 28 opens about 66° before bottom dead center (BDC), and intake valve 26 closes about 46° after BDC.

The timing of valve events portrayed by the Base Timing diagram is in stark contrast with the Fully Retarded Timing diagram. Note that with the fully retarded case the overlap period is moved such that it does not begin until intake valve opening at about 42° after TDC. Notice that the exhaust valve closes about 62° after TDC, which is a shift of about 60°. Intake valve 26 does not close until about 106° after BDC, and exhaust valve 28 opens at about BDC. The late opening of intake valve 26 allows exhaust residual to be pulled through open exhaust valve 28, causing a high level of charge dilution, which is manageable only because of the charge motion provided by: 1) CMCV 38, and 2) the relatively smaller area of the intake opening defined by intake valve 26 at the time of maximum speed of piston 14. This results from the delayed opening of intake valve 26.

Figure 4:
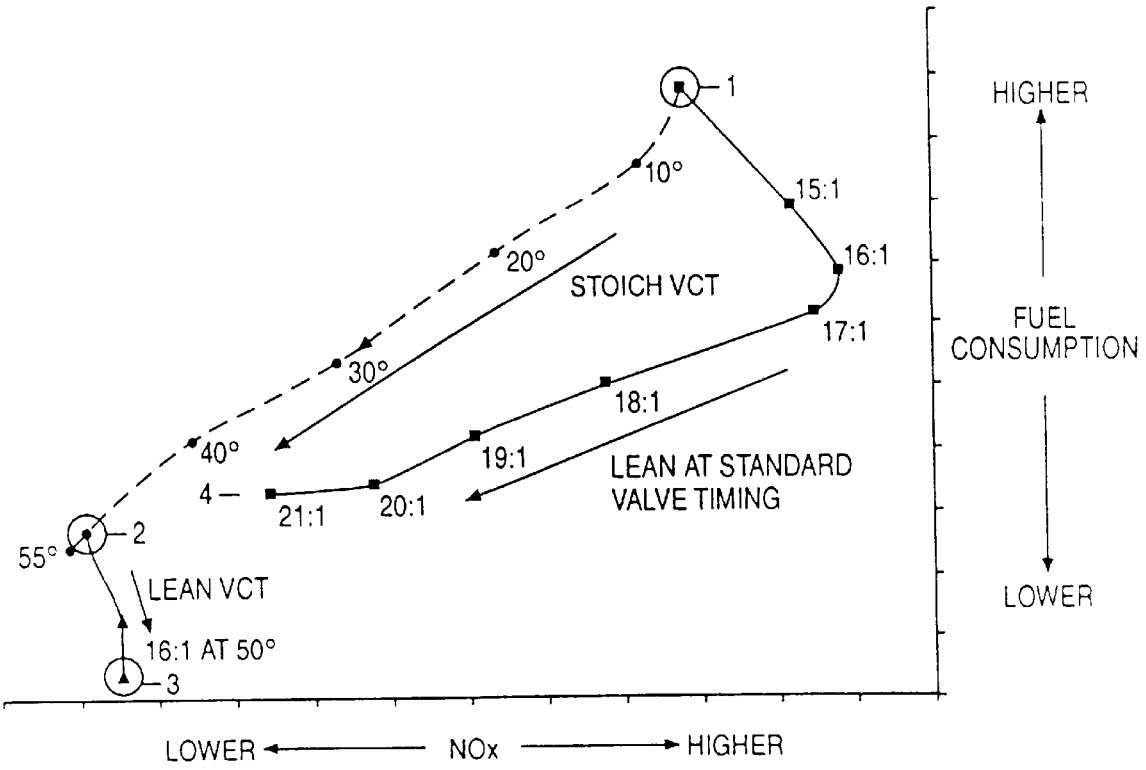
FIG. 4 is a plot of NOx emissions and fuel consumption for an engine having a valve timing and CMCV operating system according to the present invention.

The Fully Retarded Timing of FIG. 3, which is equivalent to about 60 crankangle degrees from the base timing position, produces the results shown at point 2 of FIG. 4, where the lowest NOx emission and nearly the lowest fuel consumption are present.

It has been determined with a production automotive engine that point 3 of FIG. 4 may be attained during fuel-lean operation with about 50° of camshaft retard at about 16:1 air/fuel ratio. This produces even lower fuel consumption and a very slight increase of feedgas NOx level as compared with operation at point 2 of FIG. 4.

During operation of an engine according to the present invention, controller 56 may be used to close a loop with measured combustion roughness or combustion stability. Alternatively, pressure within intake manifold 24, as measured by pressure transducer 36 may be employed as a control variable. In essence, controller 56 will retard timing of camshaft 44, thereby increasing the residual fraction of trapped exhaust until the combustion roughness reaches a threshold level, beyond which increased roughness is not desirable. Once this point has been reached, controller 56 will not retard the camshaft timing any further. It should be noted that the exact position of retarded timing will depend upon the engine speed, load, and other considerations. As an alternative, controller 56 may retard timing until the pressure within intake manifold 24, as measured by manifold pressure transducer 36, approaches ambient pressure. When the ambient pressure point is reached, further retard will cause a loss in engine output. Therefore, the degree of retard needed to be at a pressure slightly lower than ambient will be usually maintained by controller 56.

In the event that it is desirable to operate an engine according to the present invention with a lean NOx trap, shown at 30 in FIG. 1, it will be necessary to periodically purge a NOx trap by operating in a rich or at least a stoichiometric air/fuel ratio. In such case, the engine may be moved from point 3 to point 2 on FIG. 4. Notice that the fuel consumption at both points 2 and 3 is much less than fuel consumption at point 1 of FIG. 4. This is important because if the engine were operated lean, but at standard valve timing, it would be necessary to go to point 1 for purging of the lean NOx trap, with a concomitant fuel consumption penalty. Those skilled in the art will appreciate in view of this disclosure that aftertreatment device 30 could comprise either a lean NOx trap, or a three-way catalyst, or another type of exhaust aftertreatment device such as a thermal reactor.

Shifting of the operating point from point 3 to point 2 may be accomplished by providing an additional amount of fuel to the engine with approximately the same air charge, so as to minimize torque disturbances sensed by the operator of the vehicle. This is important, because operation without a torque bump will allow relatively transparent regeneration of either a lean NOx trap or transition into fuel-saving lean operation.

While the invention has been shown and described in its preferred embodiments, it will be clear to those skilled in the arts to which it pertains that many changes and modifications may be made thereto without departing from the scope of the invention.

We claim:

1. A reciprocating internal combustion engine having at least one cylinder with a piston, a crankshaft, a connecting rod joining the piston and the crankshaft, an intake manifold, and intake and exhaust poppet valves servicing the cylinder, with said engine further comprising:

a single camshaft for actuating said intake and exhaust valves;

a camshaft drive for rotating the camshaft and for adjusting the rotational timing of the camshaft with respect to the crankshaft, with the camshaft having a base timing;

a charge motion control valve for selectively imparting angular momentum to charge entering the cylinder; and a controller for operating the camshaft drive and the motion control valve, with the controller operating the camshaft drive to progressively retard the camshaft timing until the engine reaches a predetermined operating condition corresponding to maximum practicable retard.

2. An engine according to claim 1, wherein said controller operates said camshaft drive such that the exhaust valve begins to open at approximately BDC.

3. An engine according to claim 1, wherein the operating condition corresponding to maximum practicable retard is determined as a point at which the engine's combustion becomes unstable.

4. An engine according to claim 1, wherein the operating condition corresponding to maximum practicable retard is determined as a point at which the air pressure within the intake manifold approaches ambient air pressure.

5. An engine according to claim 1, wherein the motion control valve is operated by the controller such that the valve is closed during operation at low to moderate loads and opened during operation at higher to full engine loads.

6. An engine according to claim 1, wherein the base timing of said camshaft is characterized by a period of valve overlap operation proximate the TDC position of the piston and crankshaft.

7. An engine according to claim 6, wherein the base timing of said camshaft is characterized by a period of valve overlap operation slightly before the TDC position of the piston and crankshaft.

8. An engine according to claim 6, wherein the controller operates the engine with the camshaft at the base timing and the charge motion control valve in a closed position in the event that the engine is cold.

9. An engine according to claim 1, wherein said controller operates said camshaft drive such that a period of valve overlap begins at least 10° after TDC.

10. An engine according to claim 1, wherein said controller operates said camshaft drive such that a period of valve overlap begins after TDC.

11. An engine according to claim 1, further comprising a fuel delivery system operated by said controller such that the engine will be furnished with sufficient fuel to achieve fuel lean combustion during normal operating conditions and stoichiometric combustion during regeneration of a NOx trap associated with the engine.

12. An engine according to claim 11, wherein said fuel delivery system comprises a port fuel injection system.

13. An engine according to claim 11, wherein said fuel delivery system comprises a direct cylinder fuel injection system.

14. An engine according to claim 11, wherein the controller operates the camshaft drive such that once camshaft timing has been established at any particular engine speed and load, the camshaft timing will be maintained at approximately a constant value during both lean and stoichiometric combustion.

15. An engine according to claim 11, wherein the controller operates the camshaft drive such that once camshaft timing has been established at any particular engine speed and load, the camshaft timing will be maintained at approximately a constant value during both lean and stoichiometric combustion, with the controller operating the fuel delivery system to give either the lean or stoichiometric combustion with a relatively constant air charge.

16. A reciprocating internal combustion engine having at least one cylinder with a piston, a crankshaft, a connecting rod joining the piston and the crankshaft, an intake manifold, and intake and exhaust poppet valves servicing the cylinder, with said engine further comprising:

a single camshaft for actuating said intake and exhaust valves of said at least one cylinder;

a camshaft drive for rotating the camshaft and for adjusting the rotational timing of the camshaft with respect to the crankshaft, with the camshaft having a base timing;

a charge motion control valve for selectively imparting angular momentum to charge entering the cylinder; and a controller connected with a plurality of sensors for sensing engine operating condition and for operating the camshaft drive to progressively retard the camshaft timing until the engine reaches a predetermined operating condition corresponding to maximum practicable retard.

17. An engine according to claim 16, wherein the camshaft timing is retarded by approximately 60 crankshaft degrees from the base timing in the most retarded position.

18. An engine according to claim 16, wherein the controller progressively retards the camshaft timing until the engine's combustion roughness exceeds a predetermined threshold.

19. An engine according to claim 16, wherein the controller progressively retards the camshaft timing until the air pressure within the intake manifold approximates atmospheric pressure.

20. An engine according to claim 16, wherein each of said at least one cylinders has a single intake valve.

21. An engine according to claim 16, wherein each of said at least one cylinders has a plurality of intake valves.

* * * * *